US006290209B1

(12) United States Patent
Iveson

(10) Patent No.: US 6,290,209 B1
(45) Date of Patent: Sep. 18, 2001

(54) SELF-CLAMPING PUSHER

(76) Inventor: James E. Iveson, 1833 Long Ct., Gardnerville, NV (US) 89410

( * ) Notice: Subject to any disclaimer, the term of this patent is extended or adjusted under 35 U.S.C. 154(b) by 0 days.

(21) Appl. No.: 09/513,473

(22) Filed: Feb. 25, 2000

(51) Int. Cl.[7] ..... B66F 3/08
(52) U.S. Cl. ..... 254/13
(58) Field of Search ..... 254/11–17, 100; 269/41, 133

(56) References Cited

U.S. PATENT DOCUMENTS

| | | | | |
|---|---|---|---|---|
| 1,182,780 | * | 5/1916 | Limpert | 254/13 |
| 2,921,772 | * | 1/1960 | Boyd | 254/13 |
| 4,620,691 | * | 11/1986 | Waters | 254/16 |
| 5,087,019 | | 2/1992 | Peabody et al. . | |
| 5,501,754 | | 3/1996 | Hiraguri . | |
| 5,575,591 | | 11/1996 | Vanderklaauw . | |
| 5,584,158 | | 12/1996 | Johnson . | |
| 5,819,482 | | 10/1998 | Belke et al. . | |
| 5,862,635 | | 6/1999 | Linse et al. . | |
| 5,875,606 | | 3/1999 | Jensen . | |

* cited by examiner

*Primary Examiner*—Robert C. Watson
(74) *Attorney, Agent, or Firm*—Siemens Patent Services

(57) ABSTRACT

A pushing tool adapted to grip a joist and exert pushing force on a board located immediately above the joist. The tool comprises a block having a threaded bore, a screw which threads into the bore, and a clamp fixed to the block. Four arms forming dual parallelogram linkages are pivotally mounted to the block and to the jaws of the clamp such that when the block is drawn along the screw by screw action, the arms fold in the direction of parallel orientation relative to the screw. This draws the jaws of the clamp towards one another such that they engage and grip the joist. The jaws of the clamp have cleats preventing the jaws from slipping ineffectually along the joist. Continued rotation of the screw advances the screw against the board located above the joist. Pitch of the threading of the bore and the screw enable great pressure to be exerted on the board when the screw is turned by a wrench.

8 Claims, 4 Drawing Sheets

SELF-CLAMPING PUSHER

BACKGROUND OF THE INVENTION

1. Field of the Invention

The present invention relates to pushing tools, and more particularly to a tool which automatically clamps itself to one environmental object while simultaneously exerts a pushing force on a second environmental object. An illustrative application is in the field of carpentry. The tool anchors itself to, for example, a joist, while exerting a pushing force on a board which is to be nailed to that joist. Fields other than carpentry can benefit from the invention. Wherever there is an object requiring force to move beyond that which a person can reasonably exert, and that object is in close proximity to a fixed point of anchorage, the present invention can profitably be brought to bear on the object being moved.

2. Description of the Prior Art

Professional carpenters, home owners, hobbyists, and others engaging in carpentry from time to time encounter situations wherein rough and semi-finished lumber pieces such as planks and boards are warped to the point that they are barely if at all acceptable for being installed in a construction project. It is usually desired that buildings and other projects have straight, flat surfaces and perpendicular angles between boards. Warped boards and planks degrade suitability of the completed project. However, economics dictate that commercial supplies of rough and semi-finished lumber usually include warped pieces. The craftsman must deal with less than ideal lumber as best he or she can.

Lumber for constructing buildings and related structures such as exterior decks, porches, garages, and the like must be sufficiently strong to bear considerable weight. Therefore, lumber is too strong for a carpenter or other craftsman to bend into an acceptable configuration by hand. A manual tool to perform such bending is desirable when poor quality lumber is to be incorporated into a structure. The prior art has proposed jacks and similar devices for exerting pushing forces considerably greater than those which can be developed by human strength.

An example is seen in U.S. Pat. No. 5,087,019, issued to Dennis J. Peabody et al. on Feb. 11, 1992. Peabody et al. illustrates a spreader which can expand to exert a pushing force, but in which the device is arranged and acts linearly. That is, the point of anchorage is located colinearly with the axis of the device. This requires that the object receiving the pushing force be moved away from the point of anchorage. In the field of carpentry, it is frequently the case that a board being nailed into the structure being built is not suitably located for a linearly spreader to be effective. In contrast to linear spreaders, the present invention has an automatic clamp which grips a board as it expands to exert force on the board receiving force. The clamp is able to grasp a board not colinearly located with respect to the direction of expansion.

U.S. Pat. No. 5,501,754, issued to Hiroaki Hiraguri on Mar. 26, 1996, shows a device for lifting floor panels. The device of Hiraguri is essentially a linear spreader having structure for engaging floor panels. The engaging structure is located at the point receiving the pushing force. By contrast, the present invention incorporates a clamp which can grasp a supporting object located out of line with the direction of expansion.

U.S. Pat. No. 5,875,606, issued to Lars Dean Jensen on Mar. 2, 1999, describes a wall jack which expands between two opposing wall surfaces when a central screw member is turned. This device lacks a clamp found in the present invention, and cannot grasp one structural member from two sides, as can the device of the present invention.

None of the above inventions and patents, taken either singly or in combination, is seen to describe the instant invention as claimed.

SUMMARY OF THE INVENTION

The present invention provides a device which grasps one structural member of a building, and exerts a pushing force on another member of the building. The novel device includes a clamp for clamping and has a threaded rod anchored to the clamp for exerting the pushing force. The axis of rotation of the threaded rod is located relative to the clamp such that the clamp grasps a joist while enabling the rod to press against a cross member laid over the joist. The threaded rod first tightens the clamp onto the joist, then exerts pushing force against the cross member.

The invention is typically employed to straighten flooring and decking lumber such as planks and boards being nailed to joists. The flooring or decking lumber is oriented such that it is perpendicular to and above the joist. This requires a device which can anchor to the joist while exerting a pushing force parallel to but above the joist. The self-clamping pusher of the present invention includes a base block having a threaded bore through which is passed an elongated threaded rod. Clamp jaws are connected to the base block by arms acting in scissors fashion. The clamp jaws close over the joist responsive to rotation of the threaded rod as the base block rides along the threaded rod. When the clamp jaws bear against the joist such that no further closing motion is possible, the base block can no longer ride along the rod. The clamp is secured to the joist and prevented from sliding ineffectually along the joist by cleats formed in the jaws which cleats penetrate the surfaces of the joist.

Instead, continued turning of the rod urges the rod to move helically through the base block. Alternatively stated, at first, the threaded rod does not move axially after its forward end contacts the board or plank. Instead, the base block moves relative to the joist and board or plank until the clamp has fully squeezed the joist. After this, the clamp prevents the base block from moving, and the rod is forced to move relative to the board or plank. The forward end of the rod thus advances, imposing pushing force against the board or plank. Thread pitch characteristics give the rod leverage such that force developed by the device will force most boards and planks to yield to this force, and thereby straighten. In summary, the threaded rod both operates the clamp and also subsequently brings force to bear against a board or plank being straightened.

Accordingly, it is a principal object of the invention to provide a device capable of anchoring to a joist and also exerting a pushing force on lumber located above the joist.

It is another object of the invention that the device operate by rotating a single member.

It is a further object of the invention that clamping and pushing be performed sequentially such that rotation of one member first engage the joist and subsequently apply pressure to the lumber located above the joist.

Still another object of the invention is to assure secure grip of the joist.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings. dr

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
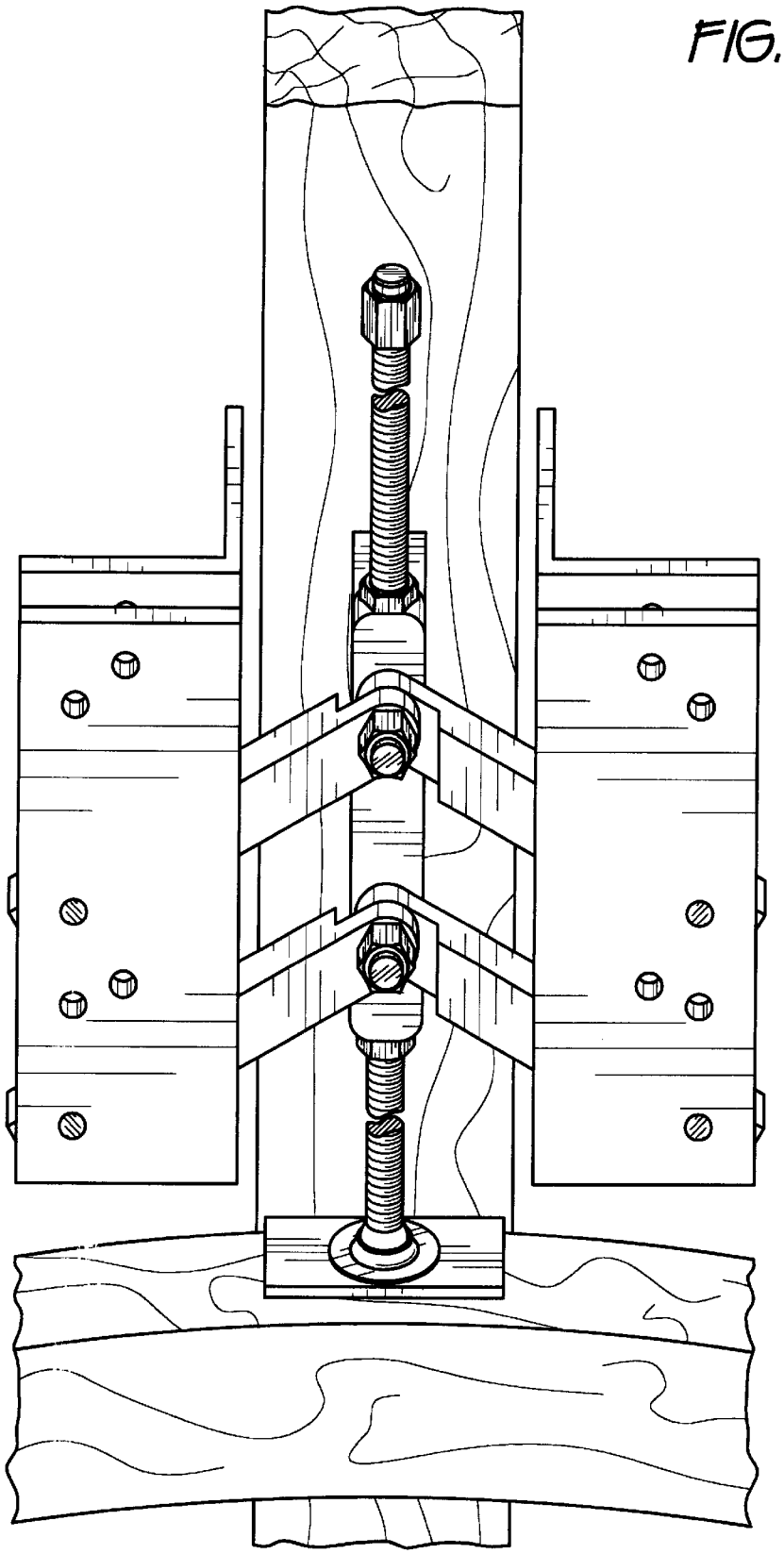
FIG. 1 is an exaggerated, environmental top plan view of an embodiment of the invention shown in an initial position engaging a workpiece.

Turning now to FIG. 1 of the drawings, self-clamping pusher 10 is shown in an initial position it would typically assume as it is placed over an elongate supporting environmental element for anchorage. Pusher 10 includes a base block 12 and an elongate projecting member held within and guided by base block 12 such that the projecting member is disposed to project linearly from base block 12 so that it can exert a pushing force against a second environmental element located in close proximity to the elongate environmental element.

A principal application of the invention is that of straightening boards and planks being joined to a joist 2, and further description will proceed with this task in mind. A board or plank (hereinafter referred to representatively as board 4) is typically laid upon joist 2 for subsequent nailing thereto. The two ends of board 4 are nailed at their two ends (not shown) to other joists (not shown). Board 4 is curved, and the center of the curve or warpage is located over joist 2 after the ends of board 4 are nailed down. Therefore, for purposes of discussion, joist 2 is the elongate supporting environmental element and board 4 is the second environmental object receiving the pushing force.

Base block 12 is a structural element which supports the projecting member, which in the preferred embodiment is a threaded rod or screw 14 and also a clamp which will be described hereinafter. Block 12 may be a solid block of metal drilled and tapped to have a threaded bore 16 which receives and guides screw 14 such that distal end 18 of screw 14 advances in the direction indicated by arrow 20 to apply force against board 4. Screw 14 has a polygonal head 15 and threads 17 matingly compatible with threads of bore 16. Alternatively, block 12 may be formed from square metallic tubing and have two threaded nuts (neither tubing nor nuts are separately shown) welded thereto at either end, thereby accomplishing a similar result as that had by drilling and tapping a solid metal block. Conventional nuts are highly suitable for the invention since they typically have thread pitch having slope characteristics such that one revolution of screw 14 advances screw 14 by a distance less than half of the diameter of screw 14. This characteristic affords leverage such that, when combined with that of a wrench (not shown) which is placed over head 15 of screw 14 for rotating or driving screw 14, considerable force is brought to bear on board 4. Still other constructions of block 12 may be employed if desired.

The clamp of the invention is fixed to base block 12 in a location out of alignment with the direction of projection of screw 14, or alternatively stated, in a location wherein the axis 13 (see FIG. 4) of screw 14 will not intersect elements of the clamp. The clamp has two opposed jaws 22, 24 disposed to move towards one another into a clamped position (see FIG. 2), thereby clamping joist 2 therebetween. Jaw 22 is held by arms 26, 28 which are pivotally connected and secured thereto by pins 30, 32 which penetrate arms 26, 28. Arms 26, 28 are pivotally connected and secured to base block 12 by pins 34, 36 which penetrate arms 26, 28 and block 12.

Jaw 24 is secured by a similar arrangement which is essentially a mirror image of that of jaw 22. The arrangement of jaw 24 includes arms 38, 40 and pins 42, 44, 46, 48. Pin 44 passes through a boss 50 projecting from block 12. The arrangement of pin 44 and boss 50 is representative of remaining pins 42, 46, 48.

Block 12 acts in conjunction with arms 26, 28, 38, 40 and with pins 30, 32, 34, 36, 42, 44, 46, 48 to serve in the capacity of an actuator disposed to move jaws 22, 24 towards one another to effect clamping action. Block 12 and its threaded bore 16 act as an actuator causing screw 14 to project from block 12 when screw 14 is rotated. The embodiment of FIG. 1 is advantageous because both actuation functions are performed simultaneously by one group of components. That is, two separate actuators are not required.

Figure 4:
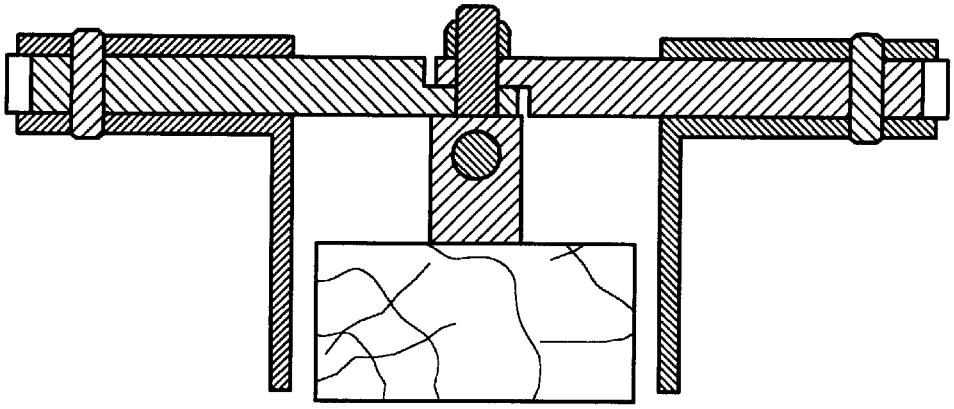
FIG. 4 is an environmental, end elevational view of the embodiment of FIG. 1, shown partially in cross section.

In operation, self-clamping pusher 10 is lowered onto joist 2 with jaws 22, 24 spread apart as seen in FIGS. 1 and 4 sufficiently such that cleats 52, 54 do not obstruct placement of pusher 10 into position. Pusher 10 is then manually held against joist 2 such that at least one cleat 52 or 54 engages the side of joist 2. When screw 14 is turned such that its distal end 18 advances in the direction of arrow 20 (see FIG. 1), screw 14 will come to abut board 4. At this point, board 4 acts as a resisting element resisting advancing motion of screw 14. Free, unfettered advance of screw 14 will then be arrested. Continued rotation of screw 14 will draw block 12 rearwardly, or in a direction opposite that of arrow 20. Ineffectual rearward travel of block 12 is prevented by engagement of cleats 52, 54 with joist 2. Arms 26, 28 and 38, 40 move in parallelogram fashion responsive to continued rotation of screw 14 when block 12 is immobilized by cleats 52, 54 and additional cleats, shown in FIG. 1 but not designated by reference numerals. Additional cleats are provided both for assuring frictional engagement of joist 2 by jaws 22, 24, and also for symmetrical and stable loading of jaws 22, 24 when they are called upon to close over joist 2 and to maintain position of block 12 relative to joist 2.

Figure 3:
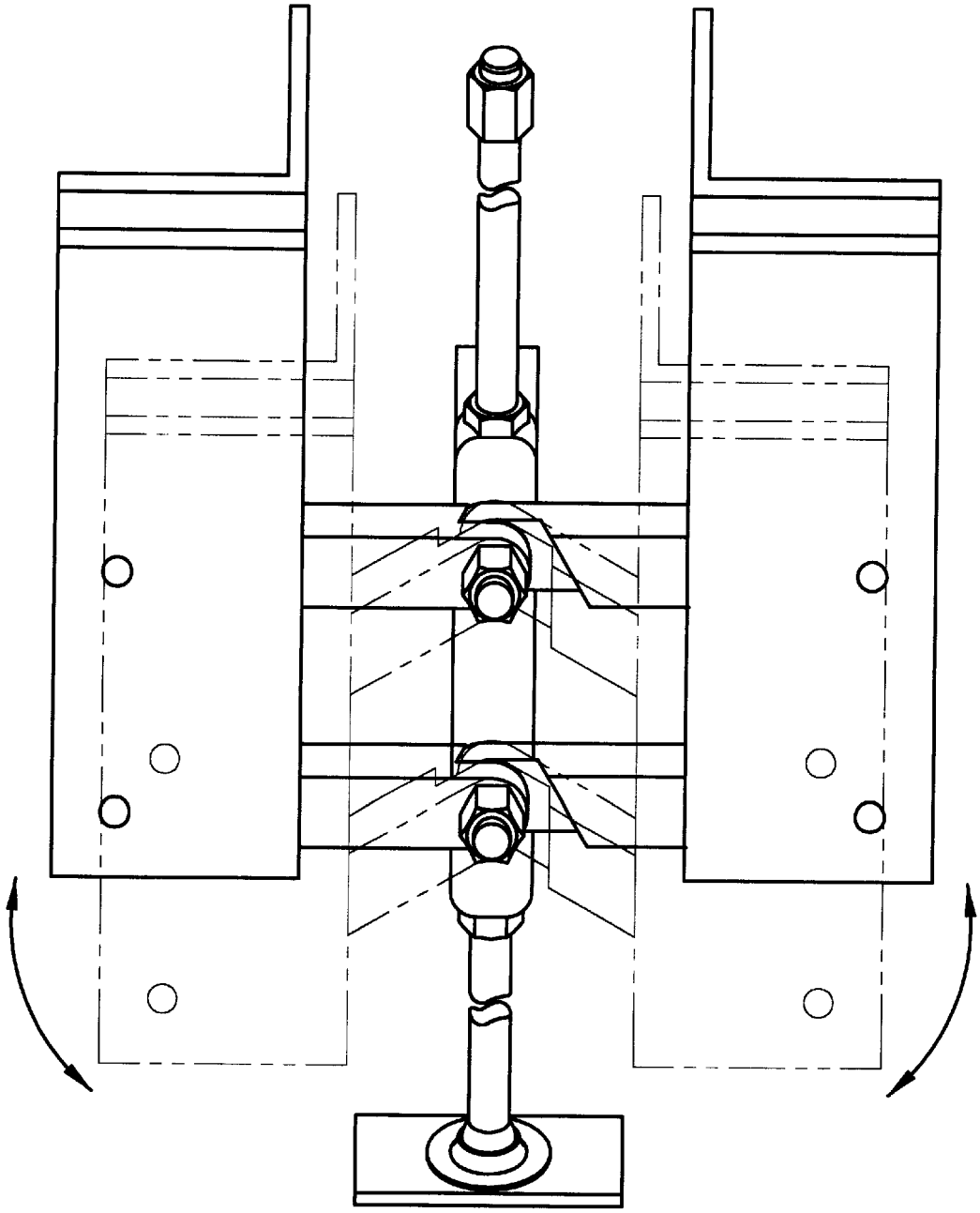
FIG. 3 is a diagrammatic detail view of the embodiment of FIG. 1 showing range of motion of components shown at the center of FIG. 1, but which components are somewhat obscured in the view of FIG. 1.

Parallelogram movement of arms 26, 28 and 38, 40 is shown diagrammatically in FIG. 3. In the depiction of FIG. 3, the fully open or spread position of jaws 22, 24 is shown in solid lines. A relatively closed or clamped position is shown in broken lines. It will be seen that arms 26, 28 remain parallel to one another and similarly arms 38, 40 remain parallel to one another. Jaws 22, 24 swing into the relatively clamped position as screw 14 is turned, as indicated by arrows 56, 58.

Figure 2:
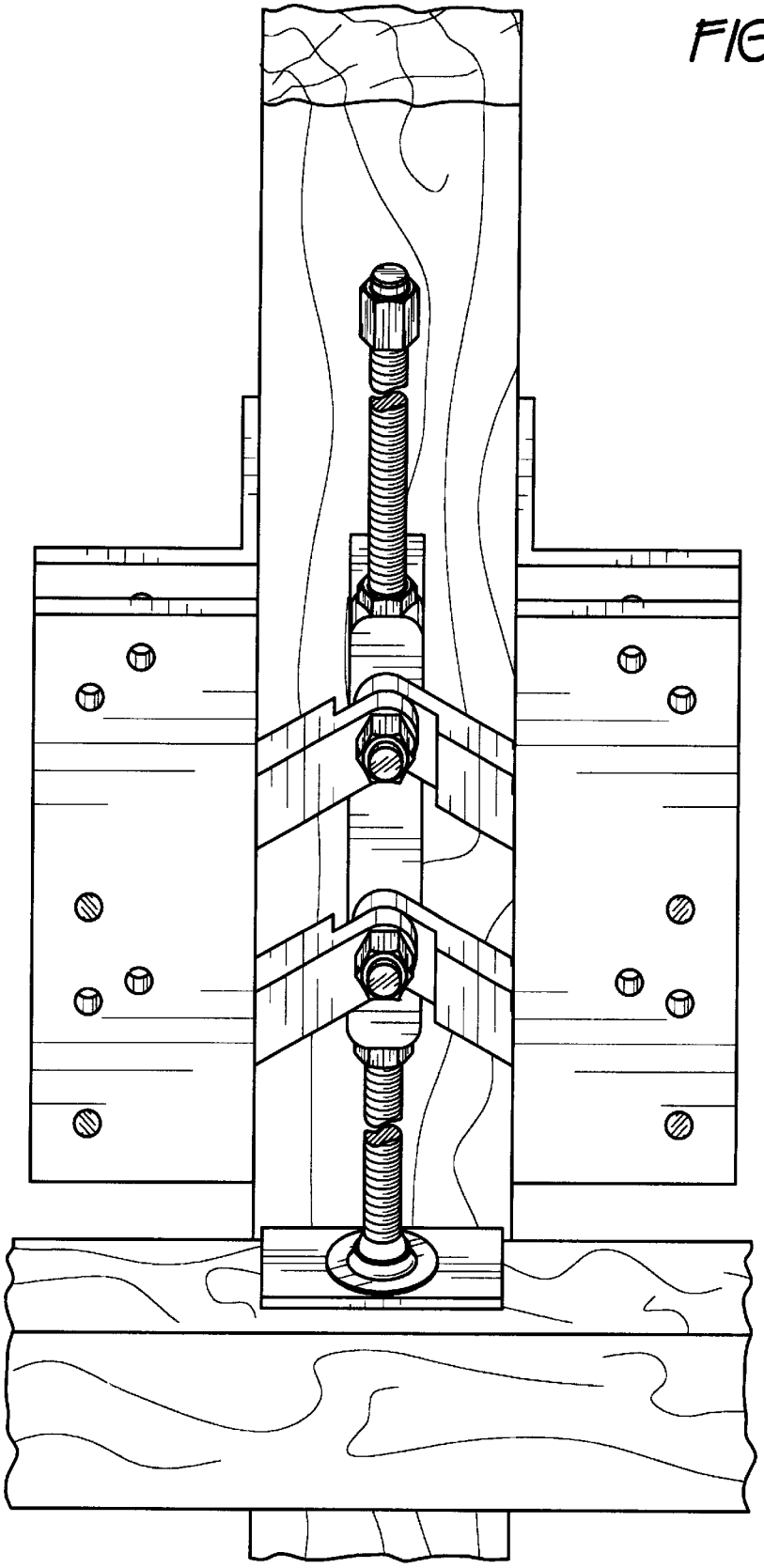
FIG. 2 is an environmental top plan view similar to FIG. 1, but showing adjustment of the novel apparatus to apply force against the workpiece.

In practice, however, and referring now to FIG. 2, block 12 moves progressively towards head 15 of screw 14 after screw 14 abuts board 4. Correspondingly, a relatively greater length of the threaded shaft of screw 14 is visible to the right of block 12 than is visible in FIG. 1. When jaws 22, 24 have closed fully over joist 2, as shown in FIG. 2, further rotation of screw 14 causes screw 14 to continue to advance in the direction of arrow 20 of FIG. 1, thereby exerting great pressure against board 4. In FIG. 1, board 4 is depicted as being considerably bowed or warped. Application of pressure under the conditions shown in FIG. 2 will eventually force board 4 to yield to screw 14, thereby assuming the straightened condition depicted in FIG. 2. This may require nailing opposed ends (not shown) of board 4 to other joists (not shown) before applying pressure.

In summary, operation proceeds in three stages. In the first stage, before screw 14 has contacted board 4, rotation of screw 14 advances screw 14 relative to joist 2. Upon contact of screw 14 with board 4, a second stage commences wherein continued rotation of screw 14 draws block 12 rearwardly relative to joist 2, assuming that the cleats engage joist 2. In the second stage, screw 14 rotates but does not move axially with respect to joist 2. When the clamp is fully closed, thereby preventing block 12 from moving rearwardly along joist 2, a third stage commences. In the third stage, further rotation of screw 14 causes screw 14 to advance once more, overcoming the resistance of board 4 and forcing board 4 to deflect under pressure exerted by screw 14. Board 4, once straightened, can then be nailed to joist 2. Self-clamping pusher 10 is removed by reversing rotation of screw 14, prying jaws 22, 24 free from joist 2 if necessary, and lifting pusher 10 from joist 2.

The present invention is susceptible to variations and modifications which may be introduced thereto without departing from the inventive concept. The actuator functions may be separated if desired and provided by separate elements. Screw actuation may be replaced by a hydraulic system or systems, or by another mechanical or electrically powered scheme, if desired.

Block 12 may be modified to be stably and symmetrically loaded when tightening screw 14. Illustratively, the various pins may pass through the entire height of block 12 such that each pin is supported at both ends within block 12. Corresponding measures may be taken with respect to the arms and clamp jaws. Boss 50 and the remaining bosses may be replaced by other structure (not shown) if desired.

Head 15 of screw 14 could be configured other than as described, provided it is keyed to accept a driving tool in close cooperation for the purposes of driving or rotating screw 14. Illustratively, head 15 could have a polygonal socket or any arrangement which assures rotation when the driving tool engages screw 14 and applies torque thereto.

The applications of the invention may be expanded from the example illustrated herein. The invention may find utility as a spreader in the field of rescue in the event of motor vehicle collisions, building collapse, and in still other fields.

It is to be understood that the present invention is not limited to the embodiments described above, but encompasses any and all embodiments within the scope of the following claims.

I claim:

1. A self-clamping pusher for anchoring to an elongate environmental element and exerting pushing force against a second environmental element disposed in close proximity to the elongate environmental element, comprising a base block having a guide;

an elongate projecting member held within and guided by said guide to project linearly from said base block;

a clamp fixed to said base block in a location out of alignment with the direction of projection of said elongate projecting member, said clamp having two opposed jaws disposed to move towards one another into a clamped position, thereby clamping the elongate environmental element therebetween; and an actuator disposed to move said jaws of said clamp together into the clamped position and to cause said projecting member to project from said base block, said actuator comprising arms connected to said base block and to said jaws of said clamp, and pins penetrating said arms and securing said arms pivotally to said base block and to said jaws of said clamp, wherein said arms move said jaws towards one another in parallelogram fashion when said actuator is operated.

2. The self-clamping pusher according to claim 1, wherein said guide of said base block is a threaded bore, and said elongate projecting member is a rod having threads matingly compatible with said threads of said threaded bore.

3. The self-clamping pusher according to claim 2, wherein the slope of said threads of said bore and of said rod is such that one revolution of said rod advances said rod by a distance less than half of the diameter of said rod.

4. The self-clamping pusher according to claim 2, wherein said rod has a keyed head for being engaged and rotatably driven by a tool.

5. The self-clamping pusher according to claim 4, wherein said keyed head is polygonal, and can be engaged and rotatably driven by a wrench.

6. The self-clamping pusher according to claim 1, wherein at least one of said jaws of said clamp has at least one cleat for engaging the surface of the elongate environmental element.

7. The self-clamping pusher according to claim 1, wherein said guide of said base block is a threaded bore, and said elongate projecting member is a rod having threads matingly compatible with said threads of said threaded bore, and said rod advances through said base block when said rod is rotated until said rod encounters a resisting element resisting advancing motion of said rod, whereupon continued rotation of said rod draws said base block rearwardly such that said arms move in parallelogram fashion, thus drawing said jaws towards one another into the clamped position, and further rotation of said rod causes said rod to exert pressure against the resisting element.

8. A self-clamping pusher for anchoring to an elongate environmental element and exerting pushing force against a second environmental element disposed in close proximity to the elongate environmental element, comprising a base block having a threaded bore having threads;

a screw having a polygonal head for engaging a wrench, and threads matingly compatible with said threads of said threaded bore, wherein said screw is held within and guided by said threaded bore to project linearly from said base block when said screw is turned the wrench, wherein the slope of said threads of said bore and of said rod is such that one revolution of said rod advances said rod by a distance less than half of the diameter of said rod;

a clamp fixed to said base block in a location out of alignment with the direction of projection of said elongate projecting member, said clamp having two opposed jaws disposed to move towards one another into a clamped position, thereby clamping the elongate environmental element therebetween; and at least four arms pivotally mounted to said base block and to said jaws of said clamp, wherein at least two of said arms are connected to each said jaw of said clamp to form a parallelogram linkage which constricts in parallelogram fashion such that said jaws of said clamp are constrained to move towards one another into the clamped position when said screw is turned while said screw abuts a resisting environmental element, and wherein each one of said jaws of said clamp has at least two cleats for engaging the surface of the elongate environmental element, whereby said screw advances through said base block when said screw is turned until said screw encounters the resisting element and the resisting element resists advancing motion of said screw, whereupon continued rotation of said screw draws said base block rearwardly such that said arms move in parallelogram fashion, thus drawing said jaws of said clamp towards one another into the clamped position, and further rotation of said screw causes said screw to exert pressure against the resisting element.

* * * * *